US006152362A

United States Patent [19]

Rosenfeld

[11] Patent Number: 6,152,362

[45] Date of Patent: Nov. 28, 2000

[54] FOOD SERVER AND CONDIMENT HOLDER

[76] Inventor: Julie H. Rosenfeld, 15A Meramec, St. Louis, Mo. 63105

[21] Appl. No.: 09/250,417

[22] Filed: Feb. 16, 1999

[51] Int. Cl.[7] ..... B65D 3/28

[52] U.S. Cl. ..... 229/400; 220/23.83; 220/737; 229/902; 229/906

[58] Field of Search ..... 229/400, 902, 229/904, 906; 220/737, 738, 23.4, 23.83; 248/311.2, 312, 312.1; 206/216

[56] References Cited

U.S. PATENT DOCUMENTS

| | | | |
|---|---|---|---|
| 1,077,027 | 10/1913 | Austin | 248/312.1 |
| 1,801,148 | 4/1931 | Gilson | 220/737 |
| 2,856,113 | 10/1958 | Brumby et al. | 229/400 |
| 3,128,984 | 4/1964 | Palm | 220/737 |
| 3,442,435 | 5/1969 | Ludder et al. . | |
| 3,926,361 | 12/1975 | Hildebrand . | |
| 4,620,631 | 11/1986 | Bartelt | 229/400 |
| 4,854,466 | 8/1989 | Lane, Jr. . | |
| 4,955,528 | 9/1990 | Schluckebier . | |
| 5,261,577 | 11/1993 | Goldstein et al. | 220/23.83 |
| 5,395,081 | 3/1995 | Vollink | 248/311.2 |
| 5,417,364 | 5/1995 | Shaw . | |
| 5,429,262 | 7/1995 | Sharkey . | |
| 5,540,333 | 7/1996 | Gonzalez et al. . | |
| 5,626,283 | 5/1997 | Mellon . | |
| 5,671,503 | 9/1997 | Uebelacker et al. | 220/737 |
| 5,720,429 | 2/1998 | Cordle . | |
| 5,775,570 | 7/1998 | Kim | 229/904 |
| 6,013,230 | 1/2000 | Kuchar | 220/738 |
| 6,076,700 | 6/2000 | Manges | 220/23.4 |

*Primary Examiner*—Gary E. Elkins
*Attorney, Agent, or Firm*—Howell & Haferkamp, LC

[57] ABSTRACT

A combination food server and condiment holder, the food server having a sidewall enclosing a food-holding volume, the sidewall having at least one slit therein; the condiment holder comprising a cup for holding at least one condiment, and a tab, connected to the cup, extending through the at least one slit in the sidewall to secure the condiment holder to the food server.

19 Claims, 4 Drawing Sheets

FOOD SERVER AND CONDIMENT HOLDER

FIELD OF THE INVENTION

This invention relates to a condiment holder, and in particular to a food server and condiment holder combination.

BACKGROUND OF THE INVENTION

A variety of foods are made more flavorful and enjoyable with condiments such as ketchup, mustard, or sauces. Conveniently serving foods with condiments is a problem that has received considerable attention. A variety of food containers have been patented that make some provision for holding condiments. Examples of these patents include Gonzalez et al., U.S. Pat. No. 5,540,333; Hildebrand, U.S. Pat. No. 3,926,361; Shaw, U.S. Pat. No. 5,417,364; Cordle, U.S. Pat. No. 5,720,429; Schluckebier, U.S. Pat. No. 4,955,528; Mellon, U.S. Pat. No. 5,626,283; Sharkey, U.S. Pat. No. 5,429,262; Lane, Jr., U.S. Pat. No. 4,854,466; and Ludder, U.S. Pat. No. 3,442,435. Many of these condiment holders are formed integrally with a food holder, complicating the manufacture of the food holders and making them more expensive. A condiment holder is not required in every instance, and thus providing condiment holder on every food container is wasteful. Some of the condiment holders are not securely attached to the food holders, or can otherwise collapse with the attendant risk of spillage. Before this invention there was no simple, inexpensive condiment holder that could be quickly and easily attached to a food serving container as needed to provide convenient access to condiments without risk of spillage.

SUMMARY OF THE INVENTION

The food server and condiment holder of the present invention is of simple and inexpensive construction, yet is safe and securely holds one or more condiments adjacent to a food server for convenient use. Generally, the food server and condiment holder combination of the present invention comprises a food server having a sidewall enclosing a food-holding volume and a condiment holder having a cup for holding at least one condiment. A tab connected with the cup is attached to the sidewall of the food container. There is preferably a slit in the sidewall of the food server, and in the preferred embodiment there are preferably two slits in the sidewall, through which the tab on the condiment holder extends.

In the preferred embodiment the condiment holder comprises a frame having an opening for receiving the cup, and the tab extends obliquely from the frame so that the cup is supported in a generally horizontal orientation. The holder is preferably made from a generally teardrop shaped blank, having a bulbous section with an opening therein forming the frame, and a tapering section forming the tab. The sections are separated by a score line along which the blank can be folded so that the tab extends obliquely from the frame section.

Thus the condiment holder of the present invention is of simple and inexpensive construction. The holder can be quickly and easily formed from a blank and securely attached to a food server. The blanks can be conveniently and compactly stored. Even after the blanks are formed into condiment holders they can be nested and compactly stored as can the condiment holding cups and the food servers. The condiment holder conveniently holds a condiment cup adjacent the food server for ready access. These and other features and advantages will be in part apparent and in part pointed out hereinafter.

BRIEF DESCRIPTION OF THE DRAWINGS

Corresponding reference numerals indicated corresponding parts throughout the several views of the drawings.

DETAILED DESCRIPTION OF THE PREFERRED EMBODIMENT

Figure 1:
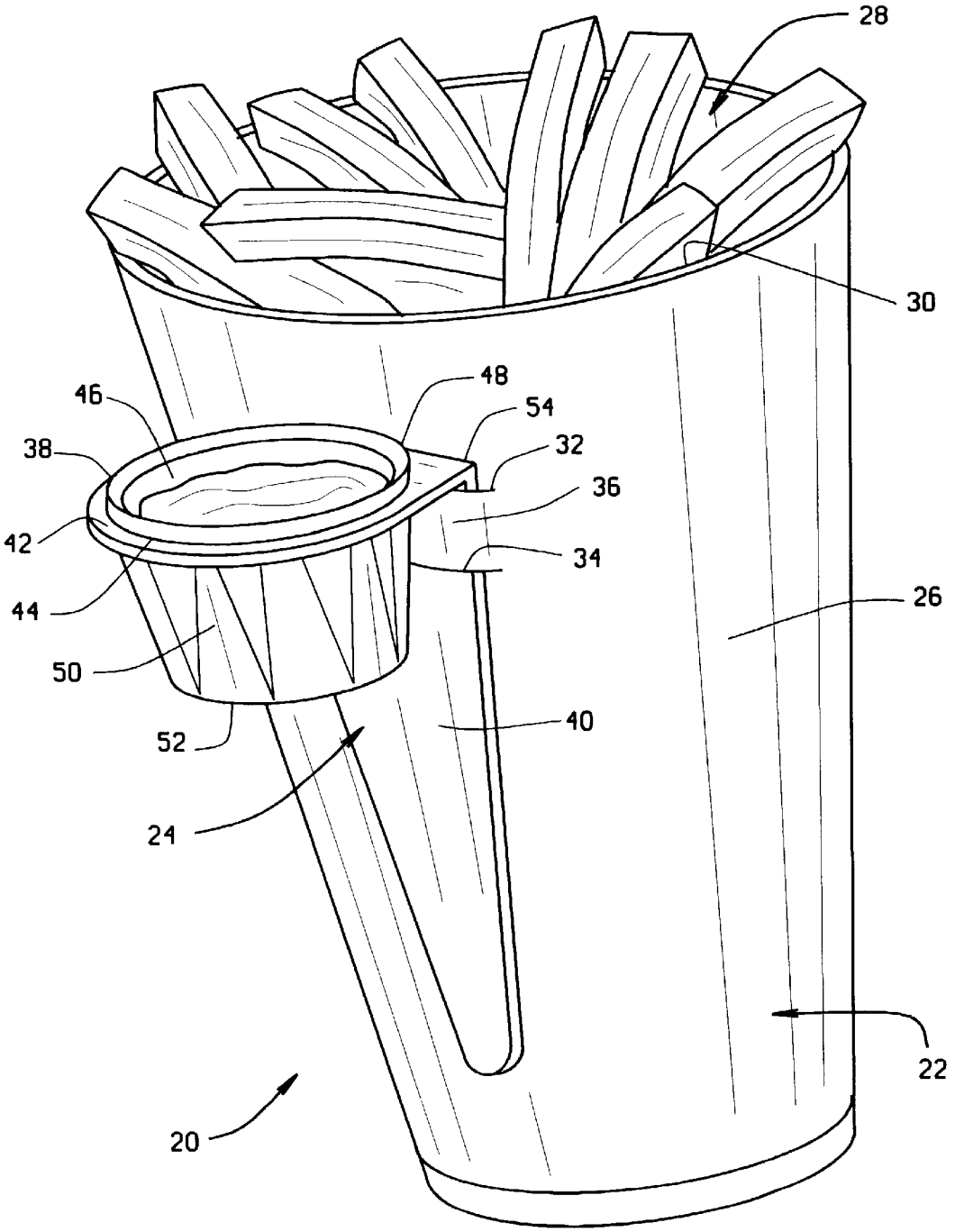
FIG. 1 is a perspective view of a first embodiment of a food server and condiment holder combination constructed according to the principles of the present invention.
Figure 2:
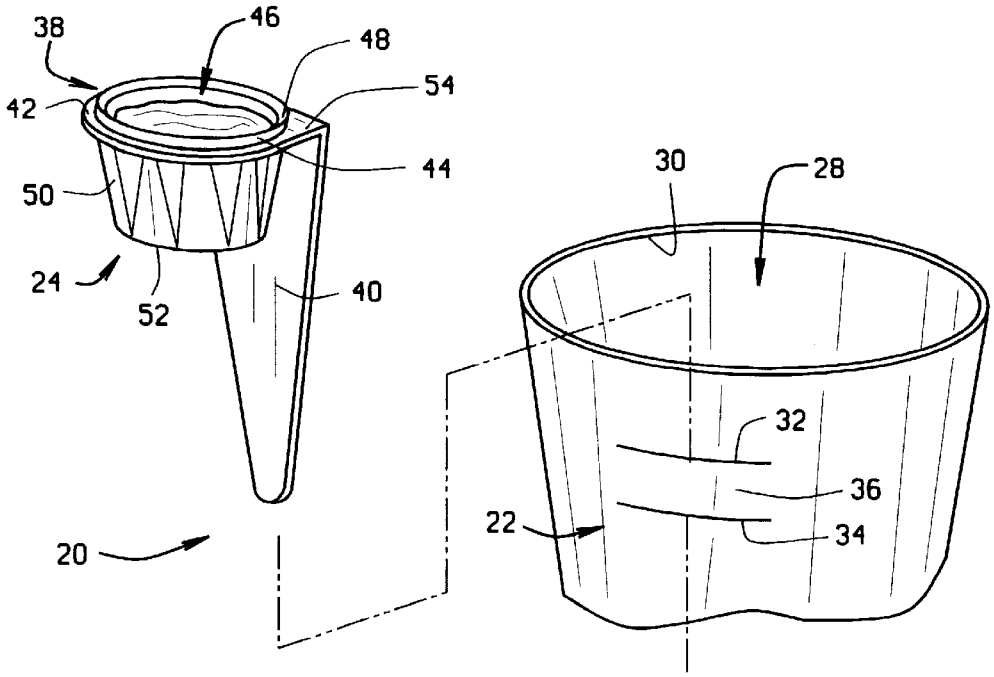
FIG. 2 is a perspective view of the food server and condiment holder of the first embodiment before the condiment holder is attached to the food server.
Figure 3:
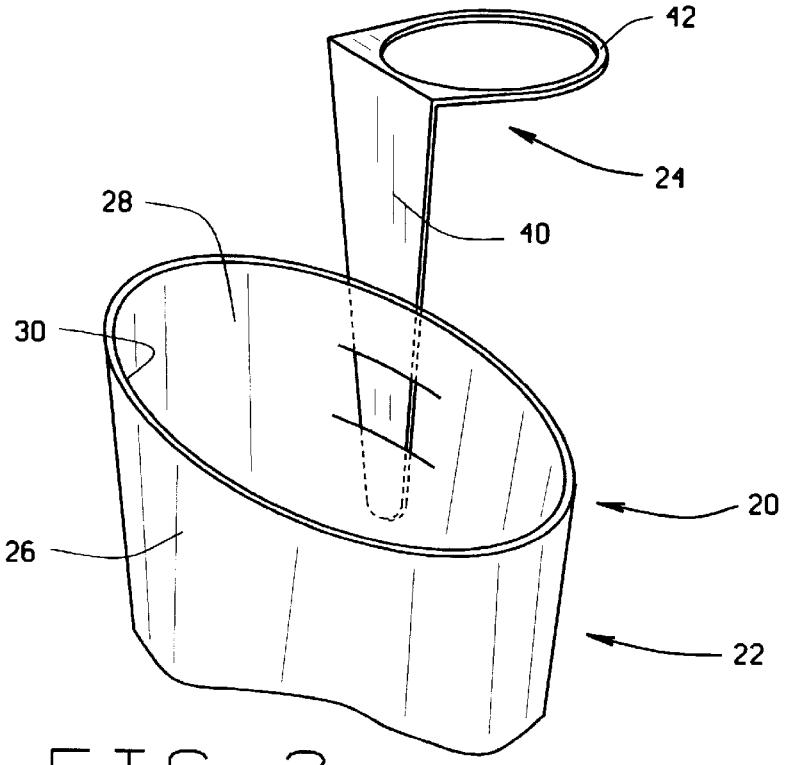
FIG. 3 is a perspective view of the food server and condiment holder combination of the first embodiment, with the condiment holder partially inserted into the slits in the food server.

A first embodiment of a food server and condiment holder combination constructed according to the principles of this invention is indicated generally as 20 in FIGS. 1 and 2. The combination 20 comprises a food server 22 and a condiment holder 24. As shown in FIGS. 1 and 2, the food server 22 comprises a sidewall 26 surrounding a food-holding volume 28. The food server 22 has an open top 30 for accessing the food in the food-holding volume 28. There is preferably at least one slit in the sidewall 26, and in this preferred embodiment there are two slits 32 and 34 in the sidewall forming a band 36. In this preferred embodiment, the food server 22 is generally cup-shaped, with a flat bottom so that the food server can stand upright. The food server can be made from plain or coated paper or cardboard. The food server 22 is adapted for serving any of a wide varieties of foods including French fries, onion, rings, chips or pretzels.

The condiment holder 24 comprises an open cup 38 for holding one or more condiments, such as ketchup, mustard, cheese, barbecue sauce, etc. A tab 40 connected with the cup extends at an oblique angle with respect to the top of the cup and is attached to the sidewall of the food server 22. In this preferred embodiment the tab 40 has an elongate, tapered configuration and extends through the slits 32 and 34 in the sidewall of the food container 22, and thus is secured by the band 36.

The condiment holder preferably comprises a frame 42 having an opening 44 therein for receiving the cup 38. The cup 38 may be a conventional paper condiment cup with an open top 46 surrounded by a rolled rim 48, a frustoconical sidewall 50, and a flat bottom 52. There is bend 54 adjacent the opening 44 from which the tab 40 extends obliquely from the frame 42, so that when the tab is attached to the food server 22, the cup 38 is held substantially horizontally, with the opening 46 of the cup generally adjacent to the opening 30 in the food server 22, so that food removed from the food server can be conveniently dipped into the cup.

Figure 5:
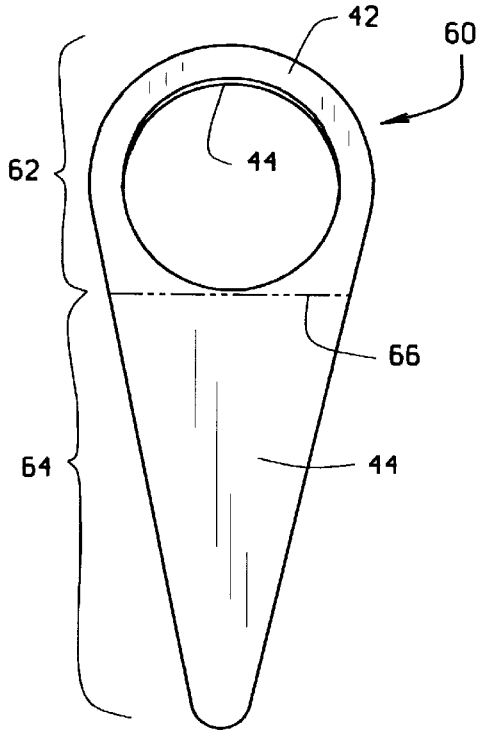
FIG. 5 is a top plan view of a blank from which the condiment holder is made.

The condiment holder 24 can be quickly and easily formed from a blank 60 (see FIG. 5), having generally tear-drop shape. The bulbous section 62 of the blank forms the frame 42, and the tapering section 64 forms the tab 40. There is a score line 66 separating sections 62 and 64 so that the blank 60 can be folded so that the tab 40 extends at an oblique angle with respect to the frame. The blank 60 is preferably made from a plastic sheet material, but it could also be made of some other material such as stiff coated or uncoated paper or cardboard, so that when the blank is folded along score line 66 the frame 42 and the tab 40 retain their respective orientations, even when a cup 38 full of a condiment is placed in the opening 44 in the frame. The assembly of the condiment holder 24 is completed by inserting a cup 38 into the opening 42, and attaching the condiment holder to the food server by inserting the tab 40 through the slits 32 and 34. Alternatively the condiment holder can be secured to the food server without the cup 38, and the cup inserted into the opening 42 later.

The frame 42 may flex at bend 54 relative to tab 40, so the distance between the edge of the opening 44 and the bend, and the distance from the frame to the bottom 52 of the cup 38 are such that the edge of the bottom of the cup can engage the sidewall of the food server 22 and hold the cup 38 substantially horizontally.

Figure 4:
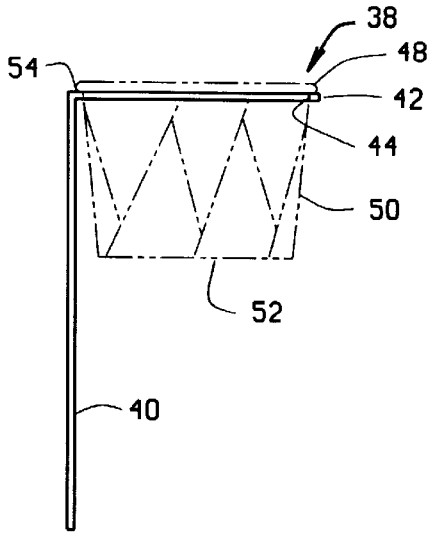
FIG. 4 is a side elevation view of the condiment holder.

The condiment holder 24 of the first embodiment can be quickly and easily formed from a blank 60 (see FIG. 4), having generally tear-drop shape. The bulbous section 62 of the blank forms the frame 42, and the tapering section 64 forms the tab 40. There is a score line 66 separating sections 62 and 64 so that the blank 60 can be folded so that the tab 40 extends at an oblique angle with respect to the frame. The blank 60 is preferably made from a plastic sheet material, but it could also be made of some other material such as stiff coated or uncoated paper or cardboard, so that when the blank is folded along score line 66 the frame 42 and the tab 40 retain their respective orientations, even when a cup 38 full of a condiment is placed in the opening 44 in the frame. The assembly of the condiment holder 24 is completed by inserting a cup 38 into the opening 42, and attaching the condiment holder to the food server by inserting the tab 40 through the slits 32 and 34. Alternatively the condiment holder can be secured to the food server without the cup 38, and the cup inserted into the opening 42 later.

The frame 42 may flex at bend 54 relative to tab 40, so the distance between the edge of the opening 44 and the bend, and the distance from the frame to the bottom 52 of the cup 38 are such that the edge of the bottom of the cup can engage the sidewall of the food server 22 and hold the cup 38 substantially horizontally.

Figure 6:
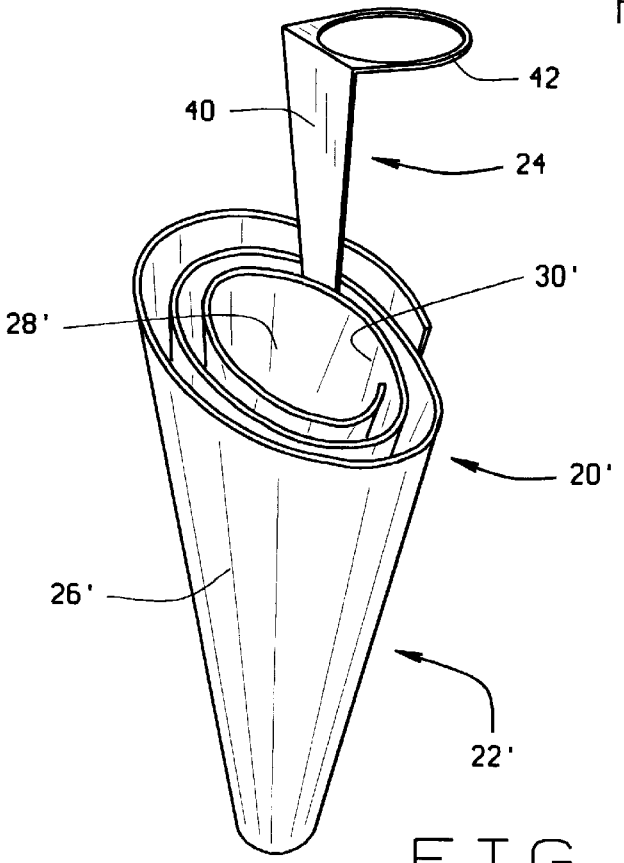
FIG. 6 is a perspective view of a second embodiment of a food server and condiment holder combination according to the principles of this invention with the condiment holder partially inserted into the slits in the food server.

A second embodiment of a food server and condiment holder combination constructed according to the principles of this invention is indicated generally as 20' in FIG. 6. The combination 20' comprises a food server 22' and a condiment holder 24. As shown in FIG. 6, the food server 22' comprises a sidewall 26' surrounding a food holding volume 28'. The food server 22' has a general cone shape, although it could have some other shape. The sidewall 26' is formed by overlapping plies. The food server 22' has an open top 30' for accessing the food in the food-holding volume 28'. There is at least one slit 32' in the sidewall 26' formed between the overlapping plies forming the sidewall.

The condiment holder 24 is the same as condiment holder 24 in the first embodiment. The tab 40 of the condiment holder 24 can be inserted through slit 32' in the sidewall 26', and extend between the plies forming the sidewall to attach the condiment holder 24 to the food server 22'.

Figure 7:
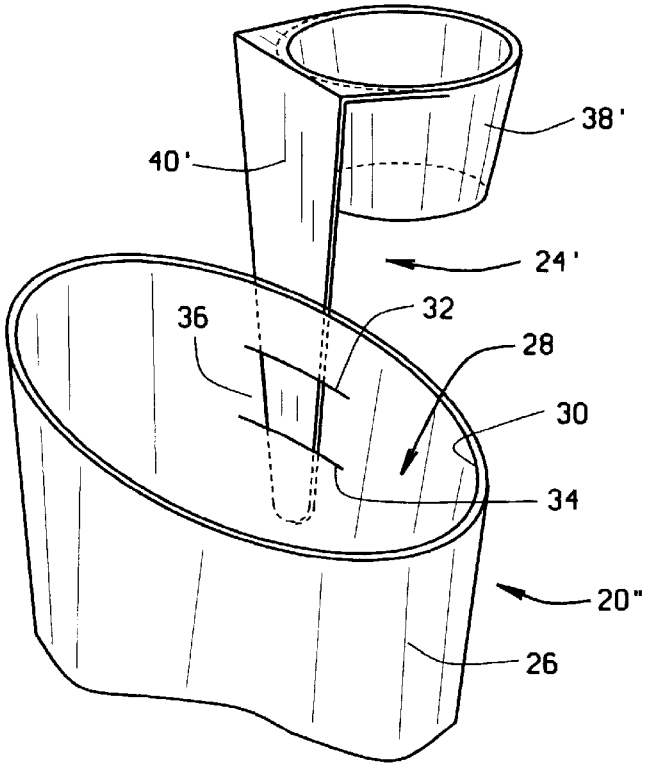
FIG. 7 is a perspective view of a third embodiment of a food server and condiment holder of a food server and condiment holder combination according to the principles of this invention, with the condiment holder partially inserted into the slits in the food server.

A third embodiment of a food server and condiment holder combination constructed according to the principles of the present invention is indicated generally as 20" in FIG. 7. The combination 20" comprises a food server 22 and a condiment holder 24'. As shown in FIG. 7, the condiment holder 24' comprises an open cup 38' for holding one or more condiments, such as ketchup, mustard, cheese, barbecue sauce, etc. A tab 40' connected with the cup 38' extends at an oblique angle with respect to the top of the cup and is attached to the sidewall 26 of the food server 22. The condiment holder 24' is preferably made of a single piece, for simplicity of manufacture and storage and may be made of molded plastic, paper, paper fiber, or cardboard. The condiment holder 24' is preferably configured to be nestable for compact storage.

Figure 8:
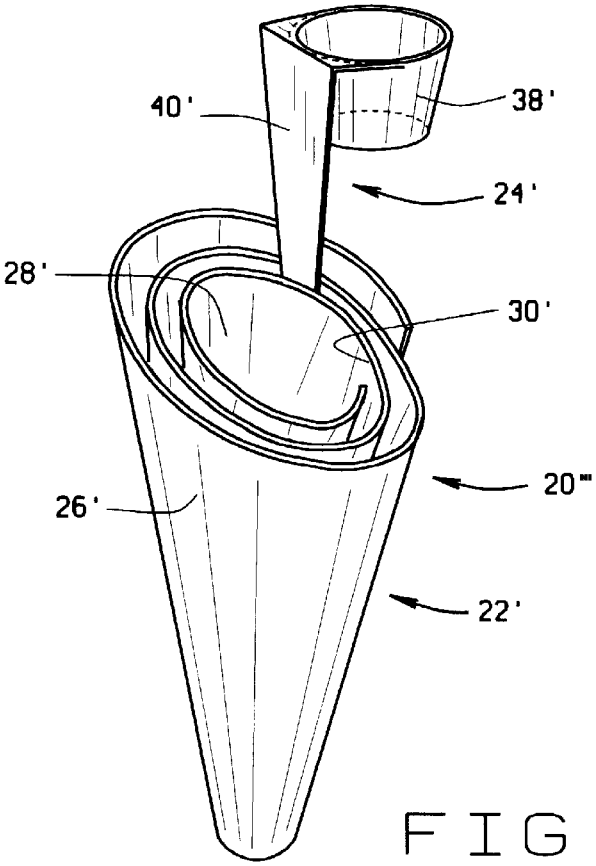
FIG. 8 is a perspective view of a fourth emobidment of a food server and condiment holder combination according to the principles of this invention, with the condiment holder partially inserted into the slits in the food server.

A fourth embodiment of a food server and condiment holder combination constructed according to the principles of the present invention is indicated generally as 20'" in FIG. 8. The combination 20'" comprises a food server 22' and a condiment holder 24'. The tab 40' of the condiment holder 22' can extend through slit 32' between the plies forming the sidewall 26' of the food server 22'.

The combination food server and condiment holder of the present invention is of extremely simple and inexpensive construction. The condiment holder 24 can be easily yet securely attached to the food server when needed. The condiment holder holds the condiments conveniently adjacent to the opening of the food server.

What is claimed is:

1. A combination food server and condiment holder, the food server having a sidewall enclosing a food-holding volume, the sidewall having at least one slit therein;

the condiment holder comprising a cup for holding at least one condiment, and a tab, connected to the cup, extending through the at least one slit in the sidewall to secure the condiment holder to the food server.

2. The combination food server and condiment holder according to claim 1 wherein the sidewall has at least two slits therein, and wherein the tab extends into one of the slits and out of the other of the slits.

3. The combination food server and condiment holder according to claim 1 wherein the condiment holder comprises a frame having an opening therein for receiving the cup, and wherein the tab is connected to the frame by a fold line.

4. The combination food server and condiment holder according to claim 1 wherein the distance between the opening and the fold line, and the distance between the frame and the bottom of the cup are such that the cup is mounted in a generally upright orientation on the sidewall.

5. The combination food server and condiment holder according to claim 1 wherein the cup and the tab are one piece.

6. The combination food server and condiment holder according to claim 1 wherein the cup and the tab are separate pieces.

7. The combination according to claim 1 wherein strap is formed in the sidewall of the food server.

8. A combination food server and condiment holder, the food server having a sidewall enclosing a food-holding volume, the condiment holder comprising a cup for holding at least one condiment, a frame having an opening therein for receiving the cup and a tab connected to the frame by a fold line, attached to the sidewall to secure the condiment holder to the food server.

9. The combination food server and condiment holder according to claim 8 wherein the distance between the opening and the fold line, and the distance between the frame and the bottom of the cup are such that the cup is mounted in a generally upright orientation on the sidewall.

10. A combination food server and condiment holder, the food server having a sidewall enclosing a food-holding volume, the sidewall having a strap therein; the condiment holder comprising a cup for holding at least one condiment, and a tab, connected to the cup, the tab extending behind the strap on the sidewall to secure the condiment holder on the food server.

11. The combination food server and condiment holder according to claim 10 wherein the strap is formed by two slits in the sidewall of the food server.

12. A combination food server and condiment holder, the food server having a sidewall enclosing a food-holding volume, the sidewall having at least one slit therein;

the condiment holder comprising a first panel having an opening therein for receiving at least one cup for holding at least one condiment, a fold line adjacent one side of the opening, and a tab having tapering sides depending from the fold line, the tab extending through the at least one slit to mount the holder on the server, and a cup in the opening in the holder, extending through the opening, the bottom of the cup disposed below the first panel.

13. The combination food server and condiment holder according to claim 12 wherein there are two slits in the sidewall, and the tab extends though both slits.

14. The combination food server and condiment holder according to claim 12 wherein the distance between the opening for the cup and the fold line, and the distance between the panel and the bottom of the cup are such that the cup is supported substantially horizontally on the sidewall of the food server.

15. A combination food server and condiment holder, the food server having a sidewall enclosing a foodholding volume, the sidewall having at least one slit therein;

the condiment holder comprising a first panel having an opening therein for receiving at least one cup for holding at least one condiment, and a tab depending from the frame, the tab extending through the at least one slit to mount the holder on the server, and a cup in the opening in the holder.

16. The combination food server and condiment holder according to claim 15 wherein the condiment holder comprises a generally tear-drop shaped blank with a bulbous frame section and a tapering tab section, an opening in the bulbous frame section, and a score line separating the frame section and the tab section for facilitating folding the of the blank between the frame section and the tab section.

17. A method of serving food with a condiment comprising:

placing food in a food serving container, the food serving container having a sidewall forming a food-holding volume, with at least one slit in the side wall;

attaching a condiment holder to the food serving container, the condiment holder comprising a frame section having an opening therein for receiving a cup for holding a condiment, and tab extending obliquely from the frame section, by inserting the tab into the at least one slit in the side wall of the food serving container.

18. A blank for forming a condiment holder adapted to be attached to a food server to hold a condiment in convenient proximity to the food server, the blank comprising a generally tear-drop shaped sheet with a bulbous frame section and a tapering tab section, an opening in the bulbous frame section, and a score line separating the frame section and the tab section for facilitating folding the of the blank between the frame section and the tab section.

19. A combination food server and condiment holder, the food server having a sidewall enclosing a food-holding volume, the sidewall including a strap; the condiment holder comprising a cup for holding at least one condiment, and a tab, connected to the cup, the tab being engaged by the strap to secure the condiment holder on the food server.

* * * * *